US005158814A

United States Patent [19]

Foti

[11] Patent Number: 5,158,814

[45] Date of Patent: Oct. 27, 1992

[54] FLEXIBLE METAL CONDUIT AND METHOD OF MAKING THE SAME

[75] Inventor: Sam J. Foti, Lyndhurst, Ohio

[73] Assignee: Hose Master, Inc., Cleveland, Ohio

[21] Appl. No.: 680,575

[22] Filed: Apr. 4, 1991

[51] Int. Cl.[5] ..... B21C 11/06

[52] U.S. Cl. ..... 428/592; 428/34.1; 428/35.3; 428/57; 428/222; 428/182; 428/184; 428/603; 428/586; 428/595; 138/122; 138/129; 138/135

[58] Field of Search ..... 138/122, 129, 135; 428/592, 34.1, 35.3, 37, 57, 121, 222, 182, 184

[56] References Cited

U.S. PATENT DOCUMENTS

| | | | |
|---|---|---|---|
| 3,331,400 | 7/1967 | Vilkaitis | 138/135 |
| 3,340,901 | 9/1967 | Lombardi | 138/173 |
| 3,435,852 | 4/1969 | Trihey | 138/122 |
| 3,815,639 | 6/1974 | Westerbarkey | 138/135 |
| 3,938,558 | 2/1976 | Anderson | 138/135 |
| 4,141,385 | 2/1979 | Siegwart | 138/135 |
| 4,197,728 | 4/1980 | McGowen | 138/135 |
| 4,220,181 | 9/1980 | Nyssen | 138/135 |
| 4,377,188 | 3/1983 | Siegwart | 138/135 |
| 4,435,460 | 3/1984 | Menzel | 428/129 |
| 4,486,484 | 12/1984 | Schafer | 138/135 |
| 4,838,317 | 6/1989 | Andre et al. | 138/135 |
| 4,977,931 | 12/1990 | Menzel | 138/135 |

*Primary Examiner*—Ellis P. Robinson
*Assistant Examiner*—Charles R. Nold
*Attorney, Agent, or Firm*—Watts, Hoffmann, Fisher & Heinke Co.

[57] ABSTRACT

A flexible metal conduit and fabrication method where a thin metal ribbon is arranged in a helix about a central axis. The ribbon defines helically extending corrugated inwardly and outwardly facing conduit surfaces formed by alternating ridges and valleys extending parallel to the ribbon edges. Ribbon edge locking structure secures abutting ribbon convolutions together and comprises first and second confronting parallel ribbon edge flanges extending at least a substantial length of the ribbon. The flanges are lapped and tightly rolled together to form a two ply spirally curved wall defining a tube whose central core has a generally circular cross sectional shape. The tube is disposed adjacent a convolution surface and extends along a helical path parallel to the abutting convolutions.

5 Claims, 4 Drawing Sheets

FLEXIBLE METAL CONDUIT AND METHOD OF MAKING THE SAME

FIELD OF THE INVENTION

The present invention relates to flexible metal conduits and more particularly to flexible metal conduits made from convoluted, corrugated metal ribbons.

BACKGROUND ART

Flexible metal conduits made from thin sheet metal ribbons which are convoluted and joined at their edges have been constructed in the past. The so-called "interlocked" conduit was a relatively commonplace example of such conduits. Interlocked conduit employed thin metal ribbons wound helically with their convolutions secured together by reversely curved ribbon edges which were interlocked. The interlocked edges permitted limited play between adjacent convolutions so the conduit could be flexed. U.S. Pat. No. 4,197,728, issued Apr. 15, 1980, discloses a conduit constructed in this manner.

Interlocked metal conduits were, and remain, in widespread use and perform in a generally satisfactory way. In some applications however, these conduits have had inadequate flexibility, convolutions have separated when too much bending was experienced, and the interlocked joints themselves have not exhibited adequate hoop strength. These deficiencies have been primarily limited to applications where relatively thin walled fairly large diameter conduits are specified.

Other flexible metal conduit constructions have been proposed in which flexibility is gained primarily by the manner of formation of the conduit convolutions. U.S. Pat. No. 4,486,484 issued Dec. 4, 1984, discloses such a conduit formed from convoluted metal ribbon which is corrugated. In this construction the helical corrugations provide flexibility while the joint between the convolutions is relatively inflexible. Other corrugated convoluted conduits have been proposed in which the convolution joints are tightly crimped but these have drawbacks related to the joint strength, the joint flexibility and/or the ability of the conduit material to form the joint.

The present invention provides a new and improved flexible metal conduit and method of making it wherein the conduit is formed from a thin corrugated convoluted metal ribbon having convolution edge locking structure in which lapped ribbon edge flanges are spirally rolled into a helical locking tube defining a core having a generally circular cross sectional shape. The tube extends along the convolution junctures and provides for a high degree of flexibility, joint integrity and joint strength.

DISCLOSURE OF THE INVENTION

According to a preferred embodiment a flexible metal conduit is constructed from a thin metal ribbon arranged in a helix about a central axis. The ribbon defines helically extending corrugated inwardly and outwardly facing conduit surfaces formed by alternating ridges and valleys extending parallel to the ribbon edges. Ribbon edge locking structure secures abutting ribbon convolutions together and comprises first and second confronting parallel flanges, each flange formed continuously with a respective edge of the ribbon and extending throughout at least a substantial length of the ribbon. The flanges are lapped and tightly rolled together to form a two ply spirally curved wall defining a tube whose central core has a generally circular cross sectional shape. The tube is disposed adjacent a convolution surface and extends along a helical path parallel to the abutting convolutions.

The present invention further features a method of making a flexible thin wall metal conduit comprising feeding a ribbon of thin sheet metal along a path of travel through a forming station to produce a corrugated shape comprising at least a ridge and adjoining valleys, the ridge and valleys extending parallel to the longitudinal extent of the ribbon. First and second opposite ribbon edge flanges are formed to extend generally parallel to each other in a direction transverse to the travel path. The ribbon is trained into a helix having a pitch corresponding to the distance between the first and second edge flanges so that the adjacent first and second edge flanges confront and engage each other with the ribbon edges disposed adjacent and parallel to each other. The first and second edge flanges are rolled into a tightly coiled spiral tube extending in a helix parallel to the ribbon convolutions to lock them together.

The projecting marginal portion of each edge flange is formed into an arcuately curved lip so that each marginal lip extends along a curved path in the same direction transverse to the direction of extent of ribbon. The lips are lapped and nested when the ribbon is trained into a helix. The lips are subjected to crushing forces which roll the nested lips into a tight spiral tube within a valley on the conduit outer surface.

Other features and advantages of the invention will become apparent from the following detailed description of a preferred embodiment made with reference to the accompanying drawings.

BEST MODE OF THE INVENTION

Figure 1:
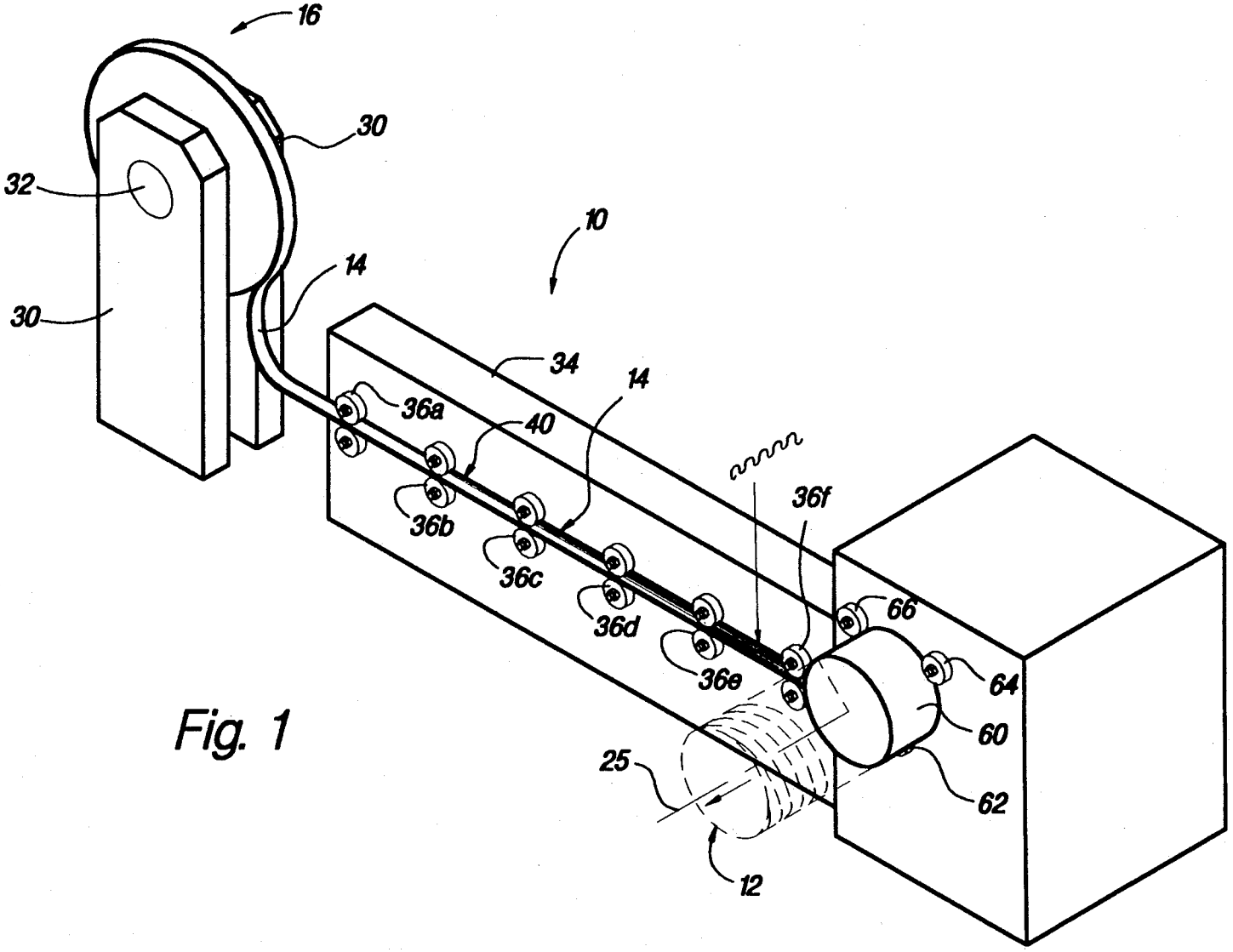
FIG. 1 is a schematic perspective view of a flexible conduit embodying the invention being fabricated using a conduit production machine.
Figure 7:
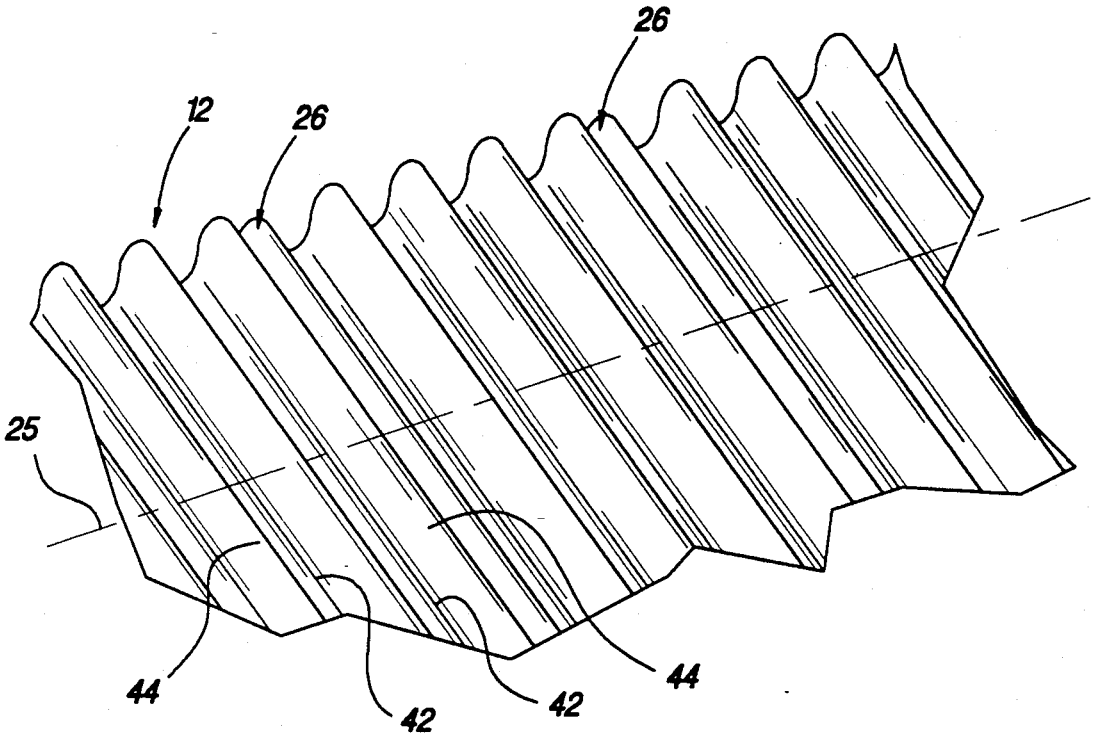

FIG. 1 schematically illustrates a machine 10 for producing conduit 12 from a narrow ribbon 14 of thin sheet metal. The machine 10 comprises a supply station 16 for a coiled ribbon, a forming roll station 20 receiving ribbon from the supply station 16 and contouring it to a predetermined cross sectional shape, and a conduit forming station 22 where the contoured ribbon 14 is helically convoluted and formed into the tubular conduit 12. The completed conduit 12 (see FIG. 7) is generated about a conduit center line 25 extending away from the machine 10 with the adjacent convolutions locked together by ribbon edge locking structure 26.

Figure 2:
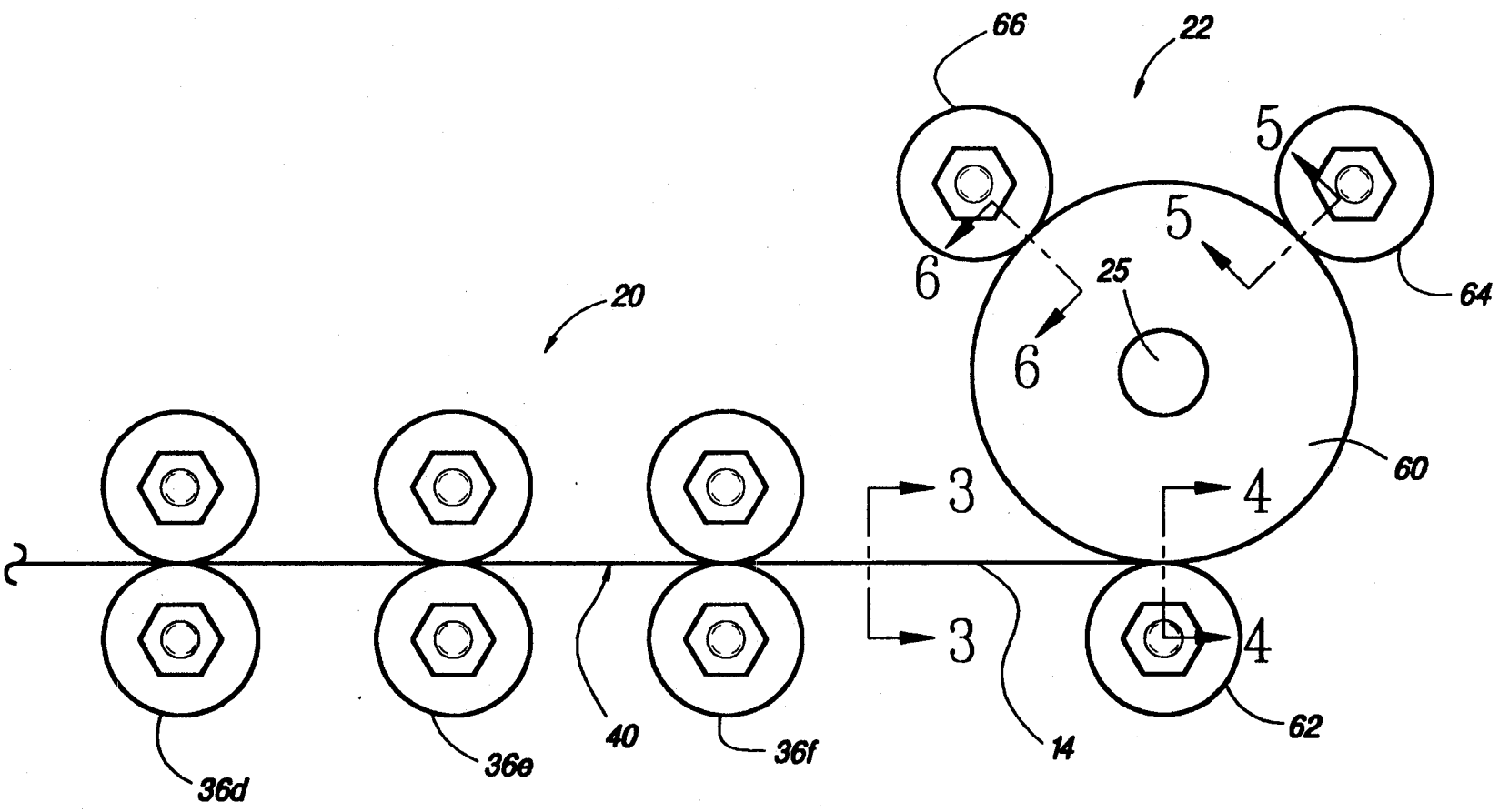
FIG. 2 is a schematic elevational view of part of the machine illustrated in FIG. 1.

The machine 10 of FIGS. 1 and 2 is illustrated schematically and described relatively briefly because it is of the sort which is generally known to those familiar with the art. See, for example, U.S. Pat. Nos. 3,938,558 and 4,197,728 which disclose generally similar machines in more detail.

The ribbon supply station 16 supports a thin flat sheet metal ribbon 14 which is fed into the roll forming station 20. The ribbon 14 is stored in a flat coil supported in a vertical orientation between stanchions 30 on a horizontal idler shaft 32. The roll forming station is constructed and arranged to pull the ribbon 14 as it forms the ribbon and the ribbon is paid off the coil as required. The ribbon can be formed from any suitable sheet metal material having a width and thickness permitting efficient conduit fabrication. For example, acceptable flexible conduit for use as a chimney liner has been made from a ribbon of 304 stainless steel which is 0.007 inches thick and 4.1 inches wide.

Figure 3:
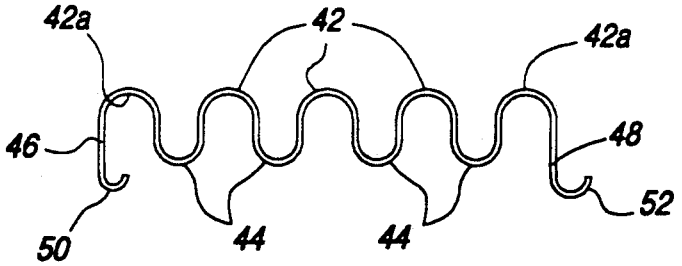
FIGS. 3–6 are cross sectional views of flexible conduit embodying the invention seen at different stages during its fabrication, each view seen approximately from the respective plane indicated by the lines 3—3, 4—4, 5—5 and 6—6 of FIG. 2; and, FIG. 7 is a fragmentary view of part of a conduit constructed according to the present invention having parts shown in cross section.
Figure 4:
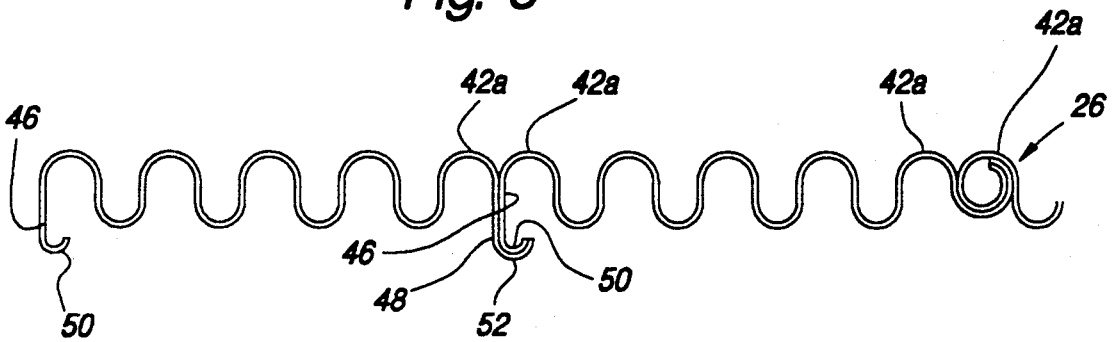

The forming roll station 20 comprises a machine housing 34 supporting six pairs of forming rolls **36*a*–36*f* through which the ribbon 14 successively passes along a path of travel 40. One roll of each pair is driven and the rolls of each pair are externally contoured and closely spaced so the ribbon is progressively formed by the roll pairs as it proceeds through successive roll nips toward the conduit forming station 22. The forming roll station 20 corrugates the ribbon 14 and provides edge flanges at opposite ribbon sides. The shape of the ribbon emerging from the roll forming station is illustrated in FIG. 3**.

The ribbon emerging from the roll forming station 20 is formed to produce the corrugated shape from at least two valleys 42 and an intervening ridge 44 extending parallel to the path of travel 40 with the valleys 42 projecting in a first direction from the path of travel and the ridge 44 projecting in a second, opposite direction from the path of travel. FIGS. 3–7 illustrated a ribbon formed with five valleys 42 and four ridges 44, each ridge located between adjacent valleys. A valley 42 extends adjacent each opposite ribbon side.

The ribbon corrugations ultimately provide the inner and outer corrugated conduit faces which in turn assure the flexibility of the finished conduit. It is preferred that the conduit forming ribbon be corrugated to provide valleys along opposite ribbon sides regardless of the number of corrugations employed. The number of corrugations, and their shapes and sizes, may be varied to suit the environment in which the completed conduit is used. The illustrated corrugations provide a sinuous, or sinusoidal, cross sectional ribbon shape which assures the ribbon is stiffly flexible transverse to the extent of the corrugations.

The locking structure 26 is comprised of first and second opposite ribbon edge flanges 46, 48 which are created in the roll forming station 20. The flanges 46, 48 extend generally parallel to each other in the second direction relative to the travel path 40. Each flange is formed continuously with and extends from adjacent the apex **42*a* of its respective adjacent valley 42 beyond the path of travel 40. The projecting marginal portions 50, 52 of the respective flanges 46, 48 are arcuately curved into conforming lips with each lip extending along a curved path in the same direction transverse to the path of travel (or direction of extent of the ribbon). In the illustrated and preferred embodiment each flange extends from the ribbon at a 90° angle and the lips 50, 52 both extend in the direction of the conduit centerline 25 (i.e. away from the machine 10**).

The ribbon 14 is fed from the roll forming station 20 to the conduit forming station 22 (FIGS. 1 and 2) where the ribbon is trained into a helix and locked to adjacent conduit convolutions to generate the conduit 12. The conduit forming station comprises a central fixed mandrel, or arbor, 60 and three pressure rollers 62, 64 and 66 disposed about the mandrel on a helical path corresponding to the conduit convolutions and extending away from the machine. The mandrel 60 is illustrated as a smooth cylindrical member centered on the conduit centerline 25 and extending, cantilever fashion, from the machine 10. The pressure rolls are illustrated as placed 120° apart about the mandrel centerline. The pressure rolls are driven and externally contoured so that they not only urge the ribbon against the mandrel to deform the ribbon but also forcefully pull the ribbon through its helical path on the mandrel.

The ribbon 14 is formed into a helix about the mandrel and the convolutions are locked together as the ribbon proceeds about the mandrel along its helical path. The conduit 12 is thus generated from the station 22 and proceeds from the machine 10 about the centerline 25. In the illustrated and preferred embodiment the ribbon is first fed between the mandrel 60 and the pressure roll 62 and proceeds in a helical path around the mandrel passing successively between the mandrel and the pressure rolls 64, 66. The ribbon proceeds back to the pressure roll 62 where it again passes between the mandrel and the roll 62, this time displaced the length of one convolution along the mandrel from the original path of its travel.

As the leading ribbon section encounters the pressure roll 62 for the second time (FIG. 4) the edge flanges confront and engage each other with the ribbon edges disposed parallel to and adjacent each other. As the engaged ribbon convolutions move around the mandrel again (FIGS. 5 and 6), the engaged edge flanges are tightly rolled together to form a two ply spirally curved wall 68 defining a tube whose central core 70 has a generally circular cross sectional shape. The locking tube is disposed adjacent the outer conduit surface and extends along a helical path parallel to the conduit convolutions thus forming the locking structure 26.

More particularly, when the engaged convolutions approach the pressure roll 62 (FIG. 4) the flange lips 50, 52 of adjacent convolutions are aligned, lapped and nested together. The flange lips are nested with their free edges adjacent each other and extending in the same direction, i.e. in the direction of extent of the mandrel 60. The pressure roll 62 engages the nested flange lips and exerts a limited crushing force which rolls the lips slightly in the direction of their extent so that they curve together slightly more tightly into the beginning of a spiral (see FIG. 4).

Figure 5:
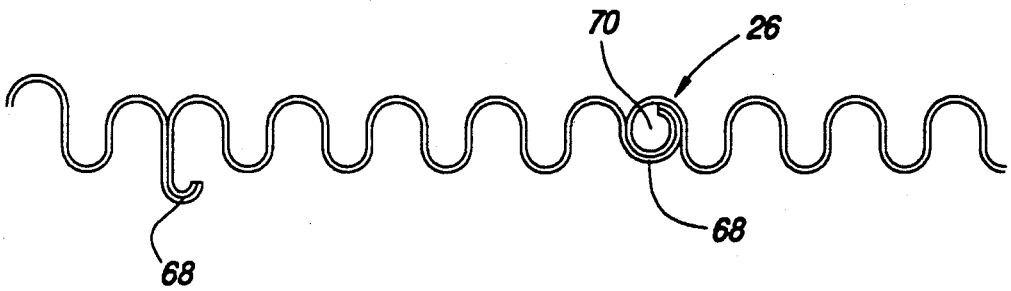
Figure 6:
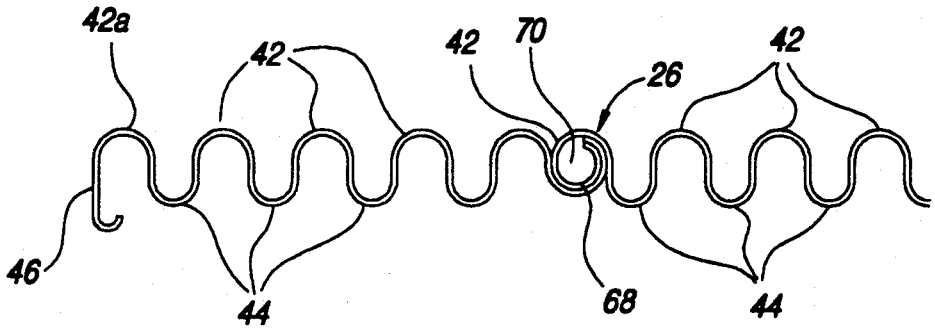

As the nested flange lips pass between the pressure rolls 62, 64 they are subjected to succeeding crushing forces which roll the flange lips still more tightly together into a tight spiral configuration (in cross section as seen in FIGS. 5 and 6) to define the two-ply spiral wall 68 and the helical locking tube core 70 coextending with the convolution juncture. The illustrated locking tube structure is rolled into a valley 42 adjacent the convolution juncture so that the convolution juncture appears, to an observer outside the conduit, to be formed by adjacent corrugation ridges (See FIG. 7). One of these "ridges" is actually the locking tube formed by the rolled edge flanges disposed in a valley 42.

Because the locking tube is rolled into a valley in the outer conduit face it is, in effect, disposed between a valley and a ridge of the outer conduit face. This locking tube location permits the conduit wall immediately adjacent each axial side of the locking tube to flex readily. Thus the conduit is not any less flexible in the vicinity of the locking structure than it is at the axial mid point of each convolution. At the same time the tightly rolled locking tube structure provides relatively great hoop strength and it tenaciously holds the convolutions in an assembled condition in the presence of bending stresses applied to the conduit. Still further, should the conduit 12 be overstressed by bending it unduly, the locking tube may fail locally at the overstressed location; but this failure will not result in widespread disassembly of the conduit convolution locks.

While a single embodiment of a conduit constructed according to the invention has been illustrated and described in detail together with a method of making it, the present invention is not to be considered limited to the precise construction and fabrication technique disclosed. Various modifications, adaptations and uses of the invention may occur to those skilled in the art to which the invention relates. The intention is to cover all such modifications, adaptations and uses which fall within the scope or spirit of the appended claims.

Having described my invention, I claim:

1. A flexible metal conduit constructed from a thin metal ribbon arranged in a helix about a central axis, with convolutions of the helix disposed adjacent each other and the ribbon defining helically extending corrugated inwardly and outwardly facing conduit surfaces formed by valleys and intervening ridges extending parallel to the ribbon edges, and ribbon edge locking structure for securing adjacent ribbon convolutions together, the locking structure comprising first and second confronting parallel flanges, each flange formed continuously with a respective edge of the ribbon and extending throughout at least a substantial length of the ribbon, said flanges being lapped and tightly rolled together to form a two ply spirally curved wall defining a tube whose central core has a generally circular cross sectional shape, the tube disposed adjacent the conduit surface and extending along a helical path parallel to the conduit convolutions.

2. The conduit claimed in claim 1 wherein the outwardly facing conduit surface immediately adjacent each of said first and second flanges is formed by an outwardly opening valley, each flange formed continuously with and extending from adjacent the apex of its respective valley outwardly with respect to the conduit, said tube disposed adjacent one of said outwardly opening valleys along the outwardly facing conduit surface.

3. The conduit claimed in claim 2 wherein said locking structure tube is disposed within said one valley.

4. The conduit claimed in claim 1 wherein said flanges extend radially outwardly with respect to said conduit.

5. The conduit claimed in claim 1 wherein said corrugations produce a sinusoidally shaped ribbon cross sectional shape.

* * * * *